US007751733B2

(12) United States Patent
Sako et al.

(10) Patent No.: US 7,751,733 B2
(45) Date of Patent: Jul. 6, 2010

(54) IMAGE FORMING APPARATUS WITH A FOG CONTROLLER

(75) Inventors: Mineyuki Sako, Toyokawa (JP); Yutaka Miyasaka, Machida (JP); Nobuyasu Tamura, Hachioji (JP); Kazutoshi Kobayashi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 873 days.

(21) Appl. No.: 11/507,617

(22) Filed: Aug. 22, 2006

(65) Prior Publication Data

US 2007/0110463 A1 May 17, 2007

(30) Foreign Application Priority Data

Nov. 14, 2005 (JP) ..... 2005-328577

(51) Int. Cl.
*G03G 15/00* (2006.01)

(52) U.S. Cl. ..... 399/45

(58) Field of Classification Search ..... 399/45, 399/49, 50, 55, 56
See application file for complete search history.

(56) References Cited

U.S. PATENT DOCUMENTS

| | | | | |
|---|---|---|---|---|
| 5,155,530 | A * | 10/1992 | Larson et al. | 399/55 |
| 5,517,283 | A * | 5/1996 | Hori et al. | 399/64 |
| 6,397,020 | B1 * | 5/2002 | Kim | 399/45 |
| 7,239,831 | B2 * | 7/2007 | Hagiwara et al. | 399/270 |
| 7,343,111 | B2 * | 3/2008 | Itagaki | 399/45 |
| 2007/0104501 | A1 * | 5/2007 | Sako et al. | 399/49 |

FOREIGN PATENT DOCUMENTS

| | | | |
|---|---|---|---|
| JP | 02110480 | A * | 4/1990 |
| JP | 5-224512 | | 9/1993 |
| JP | 08-248705 | | 9/1996 |
| JP | 10-133439 | | 5/1998 |
| JP | 11-143188 | | 5/1999 |
| JP | 11327224 | A * | 11/1999 |
| JP | 11-344880 | | 12/1999 |
| JP | 2000039745 | A * | 2/2000 |
| JP | 2000172115 | A * | 6/2000 |
| JP | 2003295584 | A * | 10/2003 |
| JP | 2004-284804 | | 10/2004 |
| JP | 2005-043473 | | 2/2005 |

OTHER PUBLICATIONS

Japanese Office Action dated Jan. 6, 2009.

* cited by examiner

*Primary Examiner*—Robert Beatty
(74) *Attorney, Agent, or Firm*—Finnegan, Henderson, Farabow, Garrett & Dunner, L.L.P.

(57) ABSTRACT

An image forming apparatus includes: a toner image carrier which carries a toner image thereon; a recording medium selection information input section to which recording medium selection information is inputted to select a recording medium to which the toner image carried on the toner image carrier is transferred; a fog controller which sets a fog control parameter value to control a fogging level of the toner image carrier; and an image forming section which forms the toner image to be carried on the toner image carrier based on the fog control parameter set by the fog controller. The fog controller sets the fog control parameter value so that the fogging level of the toner image carrier when the recording medium selection information inputted corresponds to a coated sheet, is lower than that when the recording medium selection information inputted corresponds to a normal sheet.

18 Claims, 4 Drawing Sheets

IMAGE FORMING APPARATUS WITH A FOG CONTROLLER

This application is based on Japanese Patent Application No. 2005-328577 filed on Nov. 14, 2005, which is incorporated hereinto by reference.

BACKGROUND OF THE INVENTION

The present invention relates to an image forming apparatus based on electrophotographic technology.

In the image forming apparatus based on the electrophotographic technology, a large amount of coated paper in addition to normal paper has come into widespread use in recent years, as a result of growing popularity of a color image forming apparatus. The normal paper is a transfer paper whose surface is not provided with coating, and is commonly employed in extensive applications. In the meantime, the coated paper is a transfer paper whose surface is coated with such a pigment as activated clay and is made smooth to improve the finish subsequent to image formation. The coated paper is further classified into calendared paper and other types, depending on the type of the coating medium to be used, and the degree of smoothness on the surface (Patent Document 1, that is, Japanese Unexamined Patent Application Publication No. 2004-284804).

On the other hand, in an image forming apparatus based on electrophotographic technology, a developer bearing member for bearing the developer (toner in the case of a one-component development, and toner and carrier in the case of a two-component development) is moved relative to the photoreceptor with an electrostatic latent image formed thereon, whereby the electrostatic latent image on the photo-receptor is developed. In this case, to ensure that the background fog (toner adhered to the background where toner should not adhere) does not occur, a potential difference is provided between the surface potential of the photoreceptor background portion and the bias potential of the developer bearing member (hereinafter referred to simply as "development bias" in some cases). This potential difference is called "fog margin".

However, despite adequate setting of the fog margin, the background fog (hereinafter referred to as "fog") will be deteriorated by a change with passage of time in printing a large number of sheets. This is because the developer is deteriorated by stress such as stirring, and therefore increases the amount of fog-causing poorly charged toner including insufficiently-charged toner, uncharged toner or oppositely charged toner.

One of the efforts to solve this problem is disclosed in the Patent Document 2 (Japanese Unexamined Patent Application Publication No. 05-224512) wherein toner density of toner fog is detected by a toner sensor while the development bias is changed, and the characteristic curve of toner density with respect to development bias is obtained. If the development bias capable of outputting the toner density when toner is no adhered is higher than a reference level, copying operation is carried out by increasing development bias by a predetermined amount, thereby solving the problem caused by a rise in fogging level. That is, there is described the image forming apparatus to cope with the deterioration of the fogging with the passage of time by changing the fog margin.

However, in the image forming apparatus disclosed in the Japanese Patent Application Publication No. 05-224512, the setting of fog margin is changed to eliminate the possibility of causing a fog at all times. Thus, the poorly charged toner is continuously stored in a development tank without being consumed as fog toner. With the process of time, the poorly charged toner cannot be dealt by the adjustment of fog margin, and fog deterioration occurs in a short time, as a result.

In an image forming apparatus using both normal paper and coated paper, toner transfer efficiency for the coated paper is higher than that for the normal paper, even if the amount of fog toner deposited on the photoreceptor is the same. Even if no fog occurs to the normal paper, fog does occur to the coated paper. Thus, this requires the fog margin to be set greater than that in the image forming apparatus designed for the use of normal paper alone. As a result, a greater amount of charged toner is accumulated in the development tank and fog deterioration occurs in a shorter time. Such problems have been left unsolved in the conventional art.

The object of the present invention is to solve the aforementioned problems and to provide an image forming apparatus using both normal paper and coated paper wherein high-quality image of less conspicuous fog is provided for both the normal paper and coated paper, and fog deterioration is minimized for a long period of time. This object can be achieved by the following structure:

SUMMARY OF THE INVENTION

An image forming apparatus including: a toner image carrier for carrying a toner image; a recording medium selection information input section wherein recording medium selection information is inputted to select a recording medium to which the toner image carried by the aforementioned toner image carrier is transferred; a fog controller for setting a fog control parameter value for controlling the fogging level of the aforementioned toner image carrier; and an image forming section for forming the toner image carried by the aforementioned toner image carrier based on the fog control parameter set by the aforementioned fog controller; wherein the aforementioned fog controller sets the aforementioned fog control parameter value to ensure that the fogging level of the aforementioned toner image carrier is lower when the recording medium selection information inputted into the aforementioned recording medium selection information input section is related to the coated paper, than when the recording medium selection information inputted into the aforementioned recording medium selection information input section is related to the normal paper.

DETAILED DESCRIPTION OF THE PREFERRED EMBODIMENT

Overall Structure and Basic Operation of an Apparatus

An example of applying the present invention to a tandem type full color image forming apparatus will be taken to explain the best form of embodiment of the present invention, without the present invention being restricted thereto.

Figure 1:
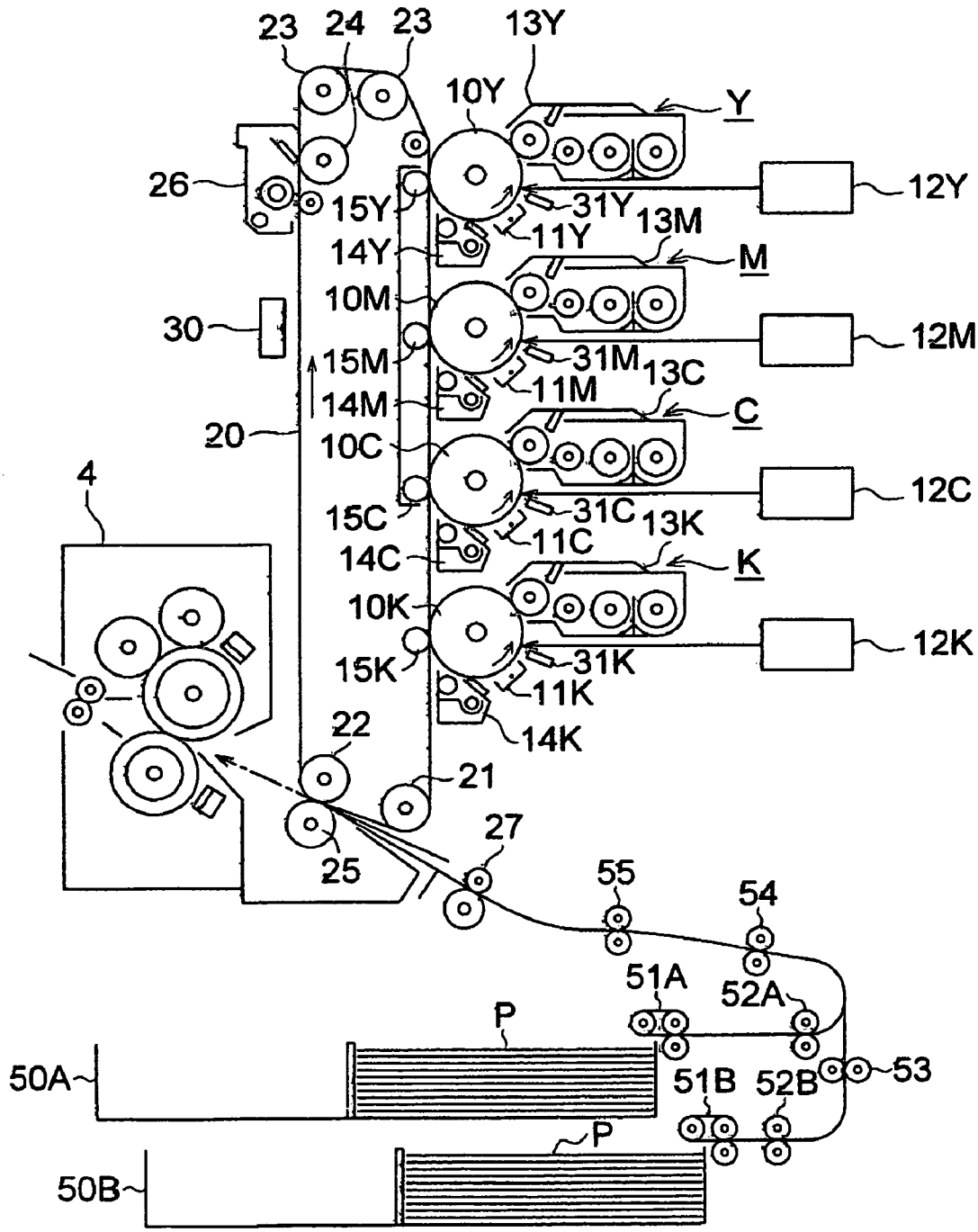
FIG. 1 is a schematic diagram representing an image forming apparatus of the present embodiment.

FIG. 1 is a schematic diagram representing an image forming apparatus of the present embodiment. The yellow image forming section Y, magenta image forming section M, cyan image forming section C, and black image forming section K are provided in the traveling direction of the intermediate transfer member 20 (toner image carrier) In the yellow image forming section Y, a charging unit 11Y, exposure unit 12Y, developing device 13Y, cleaning device 14Y, surface potential sensor 31Y are arranged around a photoreceptor 10Y (electrostatic latent image carrier or toner image carrier) in the rotating direction of the photoreceptor 10Y. An exposure unit 12Y exposes imagewise the surface of the photoreceptor 10Y uniformly charged by the charging unit 11Y so that a latent image is formed. When this latent image has been developed by the developing device 13Y, a yellow toner image is formed on the surface of the photoreceptor 10Y.

A primary transfer roller 15Y as a transfer unit is arranged on the side opposite to the yellow image forming section Y wherein the intermediate transfer member 20 is located in-between. When a predetermined voltage is applied to the primary transfer roller 15Y, a yellow toner image on the photoreceptor 10Y is transferred onto the intermediate transfer member 20. In the meantime, the surface of the photoreceptor 10Y having passed the side opposed to the primary transfer roller 15Y reaches the side opposed to the cleaning device 14Y, and the residual toner without being been transferred by the primary transfer roller 15Y is collected by the cleaning device 14Y.

The magenta image forming section M, cyan image forming section C, and black image forming section K have the same structure as that of the yellow image forming section Y, and will not be described to avoid duplication.

The image forming apparatus of the present embodiment has two modes, namely, a monochromatic mode and a full color mode. In the monochromatic mode, the contact pressure of primary transfer rollers 15Y, 15M and 15C to photoreceptor 10Y, 10M, 10C is released. The portion of the intermediate transfer member 20 opposed to the primary transfer rollers 15Y, 15M and 15C is kept apart by the photoreceptors 10Y, 10M and 10C. The primary transfer rollers 15Y, 15M and 15C are integrated into one unit. The contact pressures of the primary transfer rollers 15Y, 15M and 15C are released synchronically. In the full color mode, contact pressures of all the primary transfer rollers 15Y, 15M, 15C and 15K are applied. The contact pressure of the primary transfer roller 15K is always applied to the photoreceptor 10K whether in the monochromatic or full color mode.

The toner images formed in the image forming sections Y, M, C and K are superimposed on the intermediate transfer member 20, whereby a full color toner image is formed.

The intermediate transfer member 20 is designed in a belt-shaped structure and is entrained about the drive roller 21, earth roller 22, tension roller 23 and driven roller 24. The intermediate transfer member 20 is moved by rotation of the drive roller 21 by a drive motor (not illustrated).

A secondary transfer roller 25 is provided on the side opposite to the earth roller 22 wherein the intermediate transfer member 20 is located in-between. A path is arranged between the intermediate transfer member 20 and secondary transfer roller 25, and the recording medium P having passed through a timing roller 27 runs through this path. When a predetermined voltage is applied to the secondary transfer roller 25, the full color toner image on the intermediate transfer member 20 is transferred to the recording medium P. The fixing unit 4 is used to fix the image on the recording medium P subsequent to transfer.

A cleaning unit 26 is provided on the side opposite the driven roller 24 wherein the intermediate transfer member 20 is located in-between. The remaining toner without having been transferred by the secondary transfer roller 25 is collected.

A fog level detection sensor 30 is arranged opposite the position downstream from the secondary transfer roller 25 of the intermediate transfer member 20 and upstream from the cleaning unit 26. In the fog variation correction control to be described later, the detection patterns formed by the image forming sections Y, M, C and K are transferred onto the intermediate transfer member 20 by the primary transfer rollers 15Y, 15M, 15C and 15K. The fog level of detection patterns are detected by the fog level detection sensor 30. When the fog is detected, transfer by the secondary transfer roller 25 is not performed.

A recording medium P is stored in the sheet cassettes 50A and 50B, and the ends of the sheet cassettes 50A and 50B are provided with sheet feed rollers 51A and 51B, respectively. The recording medium P accommodated in the sheet feed cassette 50A is fed by the sheet feed roller 51A and is supplied to a timing roller 27 through a conveyance roller 52A, conveyance roller 54 and conveyance roller 55. Similarly, the recording medium P accommodated in the sheet feed cassette 50B is fed by the sheet feed roller 51B and is supplied to the timing roller 27 through the conveyance roller 52B, conveyance roller 53, conveyance roller 54 and conveyance roller 55.

(Structure of Image Forming Section and the Process of Image Formation)

Figure 2:
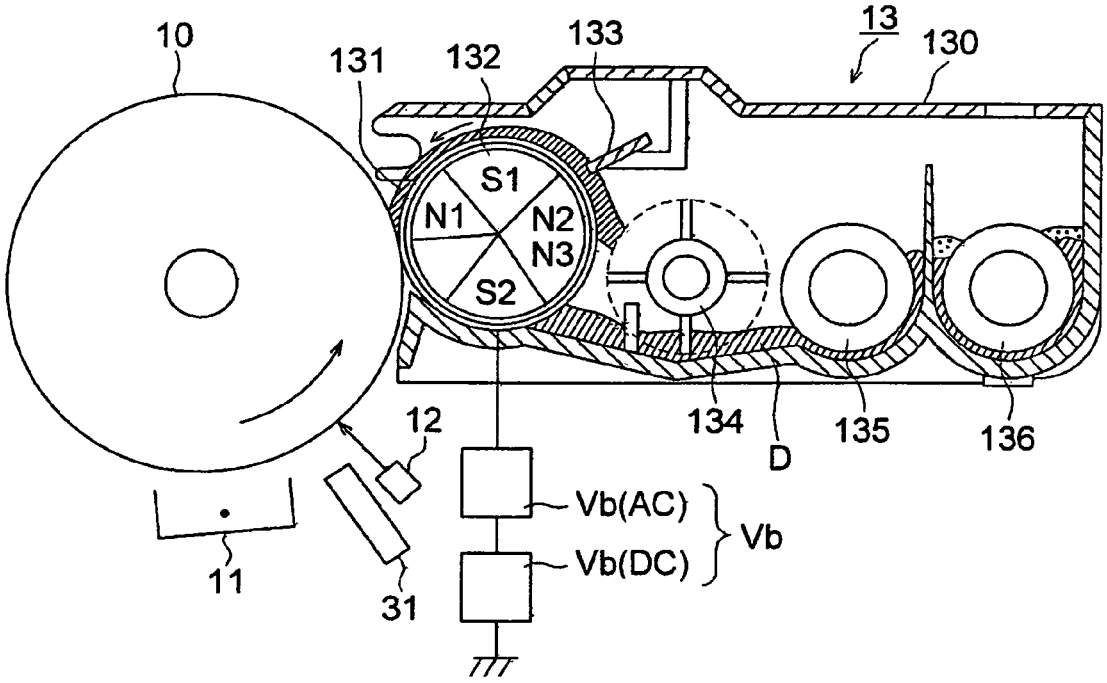
FIG. 2 is a schematic diagram representing an image forming section of the present embodiment.

FIG. 2 is a detailed drawing of the image forming sections Y, M, C and K of FIG. 1. The image forming sections Y, M, C and K are designed in one and the same structure. Accordingly, the following description will omit the symbols Y, M, C and K at the ends of the components of the image forming sections.

The following describes the present embodiment with an example taken from the case of reversal development by applying a negative development bias using a negatively charged photoreceptor and negatively charged toner. However, the present invention is not restricted thereto. The present invention is also applicable to reversal development by applying a positive development bias using a positively charged photoreceptor and positively charged toner. The present invention is applicable to the normal development as well.

The photoreceptor 10 is a negatively charged photoreceptor, which turns in the arrow-marked direction in the drawing. A phthalocyanine based photoreceptor can be used as a negatively charged photoreceptor.

The charging unit 11 allows the surface of the photoreceptor 10 to be negatively charged. A charging unit such as a scorotron charging unit and roller charging unit can be used. A surface potential sensor 31 is used for charged potential control. When the output value of the surface potential sensor 31 is fed back to the output of the charging unit 11, the charged potential can be placed under control.

In response to the image data, the exposure unit 12 exposes imagewise the photoreceptor 10 negatively charged by the charging unit 11 so that a latent image is formed on the surface of the photoreceptor 10. A semiconductor laser and LED (Light Emitting Diode) array can be used as a light source of the exposure unit 12.

The developing device 13 of the present embodiment will be described in the case of using a two-component developing device is used. It is to be understood, however, that the one-component developing device can be used. A developer mainly composed of toner and carrier is incorporated in the casing 130. The toner is negatively charged toner negatively charged by triboelectric charging with the carrier.

A development sleeve 131 carries a developer D and turns in the arrow-marked direction of the drawing (moves in the direction opposite the photoreceptor traveling direction at the position opposed to the photoreceptor). This allows the developer D to be supplied to the portion opposed to the photoreceptor 10. A magnet roll 132 for retaining the developer on the development sleeve by magnetic force is fixed inside the development sleeve 131. A regulating blade 133 for regulating the amount of developer on the development sleeve 131 is arranged inside the casing 130 at the position opposed to the development sleeve 131. A paddle roller 134 for supplying a developer to the development sleeve 131 is provided upstream of the regulating blade 133 in the rotating direction of the development sleeve 131, opposed to the development sleeve 131. The conveyance screws 135 and 136 are arranged on the side opposed to the development sleeve 131 through the paddle roller 134. These screws are used to circulate, mix and stir the developer inside the casing 130.

In the developer having been circulated, mixed and stirred by the conveyance screws 135 and 136, toner is negatively charged and the carrier is positively charged by triboelectric charging between toner and carrier. The charged developer is supplied to development sleeve 131 through the paddle roller 134. The height of the developer having been supplied to the development sleeve 131 is regulated by the regulating blade 133, and is supplied to the portion opposite to the photoreceptor 10.

The development bias Vb for controlling the amount of toner adhered to the photoreceptor 10 is applied to the development sleeve 131. The development bias Vb of the present embodiment will be explained using an example of a development bias wherein DC component Vb (DC) and AC component Vb (AC) are superimposed. The development bias made up of a DC component alone can also be utilized.

Figure 3:
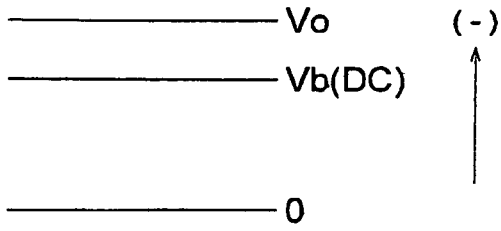
FIGS. 3(*a*), 3(*b*), 3(*c*) are a transition diagram showing the relationship between the photoreceptor potential and developing bias potential in an image forming process.
Figure 3:
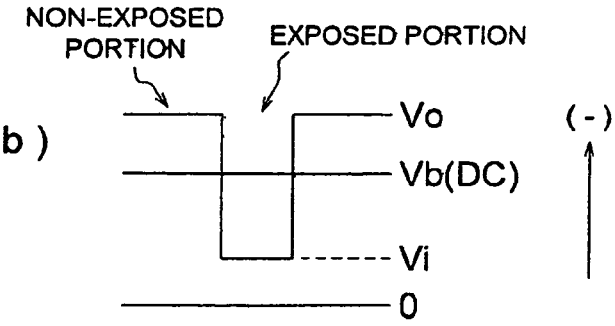
Figure 3:
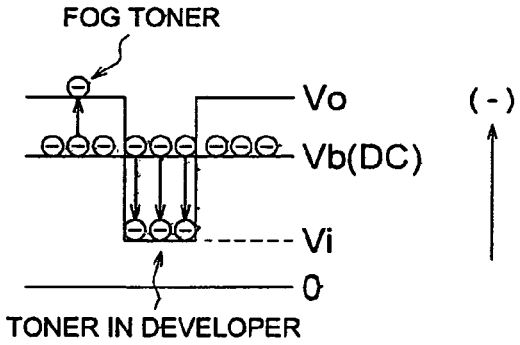

FIGS. 3(*a*) through 3(*c*) are transition diagrams representing the relationship between the photoreceptor potential and development bias potential in an image forming process. Firstly, the surface of the photoreceptor 10 is negatively and uniformly charged by the charging unit 11. In this case, the reading of the surface potential sensor 31 is fed back to the charging unit 11 and the photoreceptor 10 is charged to a predetermined charged potential (V0) (FIG. 3(*a*)).

The surface of the photoreceptor 10 charged to have a predetermined negative potential is exposed imagewise by the exposure unit 12 based on the image data. This procedure reduces the absolute value of the negative potential of the exposed portion (Vi), so that an electrostatic latent image is formed (FIG. 3(*b*)).

The surface of the photoreceptor 10 with an electrostatic latent image formed thereon reaches the portion opposed to the development sleeve 131, where development is carried out. The development bias Vb is applied to the development sleeve 131, and toner in the developer adheres to the portion exposed imagewise by an exposure unit 12. Further, if the difference between the surface potential V0 and potential of the development bias Vb (DC) is not sufficiently great, insufficiently charged toner inside the casing 130 as fog toner will adhere to the non-exposed portion (FIG. 3(*c*)).

(Fog Control)

<Fog Control Structure>

Figure 4:
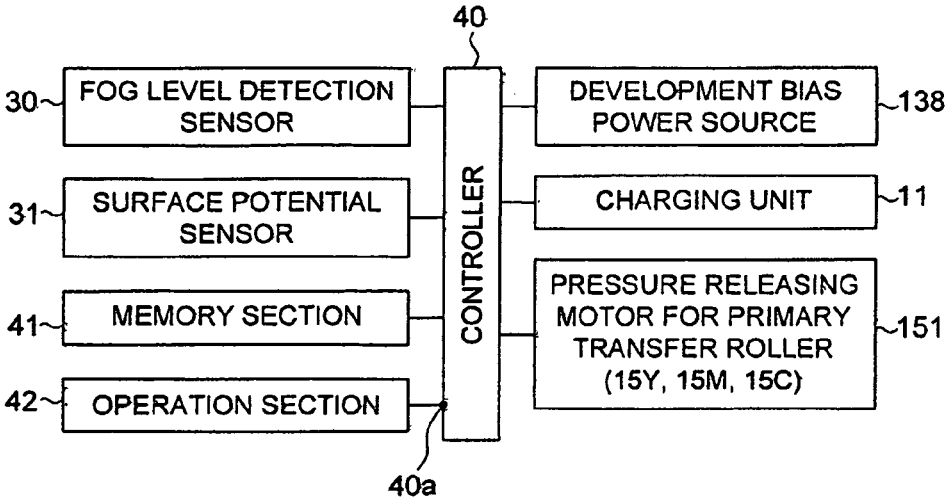
FIG. 4 is a block diagram representing the control structure of the fog control of the present embodiment.

FIG. 4 is a block diagram representing a fog control structure of the present embodiment. It shows only the control structure related to fog control, other control structures being omitted. It is mainly formed of many components including a controller 40 (fog controller) to provide fog control according to the program.

The memory section 41 stores a fog control program, the number of prints, reference fogging level value to be described later, type of the recording medium (e.g. coated paper, normal paper) accommodated in the sheet cassettes 50A and 50B, and the correction value for various recording media for reference fog control parameter value to be described later. The operation section 42 is used to set image formation conditions including the selection between the sheet cassettes 50A and 50B, and to designate start of image formation. The fogging level detection sensor 30 is a reflection type optical sensor. The output value (fogging level value) corresponding to the fogging level on the intermediate transfer member 20 is inputted into the controller 40 through the operation section 42. The surface potential sensor 31 inputs the output value corresponding to the surface potential of the photoreceptor 10 into the controller 40.

The development bias power source 138 is a power source to apply development bias Vb to the development sleeve 131. Under fog control, the controller 40 provides control in such a way as to output the development bias Vb determined by the output value of the fog level detection sensor 30. In the present embodiment, the development bias Vb contains the DC component Vb (DC) and AC component Vb (AC) superimposed thereon. The Vb (DC) value, Vb (AC) peak-to-peak value and Vb (AC) frequency can be controlled by the controller 40.

In the charging unit 11, the charged output value is adjusted by the controller 40 based on the output value of the surface potential sensor 31.

The pressure release motor 151 of the primary transfer rollers (15Y, 15M and 15C) is a motor to switch the contact pressure of the primary transfer rollers 15Y, 15M and 15C between the full color mode and the monochrome mode. Under the full color mode, the primary transfer rollers 15Y, 15M and 15C are switched over to the state of contact pressure by the controller 40. Under the monochrome mode, the primary transfer rollers 15Y, 15M and 15C are switched over to the released state by the controller 40.

<Fog Area Ratio for Normal Paper and Coated Paper>

Figure 5:
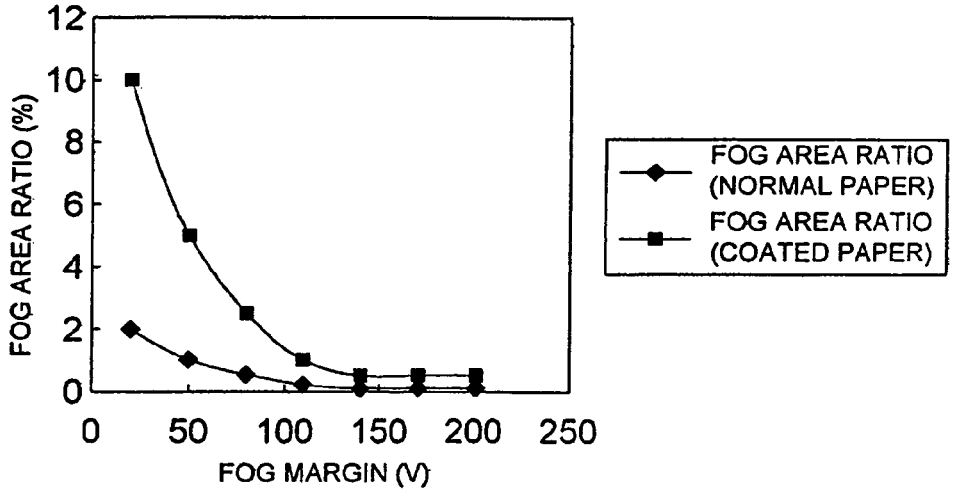
FIG. 5 is a characteristic diagram representing the relationship between the fog margin and fog area ratio in the normal paper and coated paper of the present embodiment.

FIG. 5 is a characteristic diagram representing the relationship between the fog margin and fog area ratio in the normal paper and coated paper. This characteristic diagram is strictly an example. It goes without saying that the absolute value differs according to the apparatus configuration, environmental conditions and others. The fog margin refers to the absolute value of the difference between the surface potential V0 of the photoreceptor and the DC component Vb (DC) of the development bias (FIG. 3(*c*)). The fog area ratio can be defined as the proportion of the toner deposited area (fog toner of four colors—Y, M, C and K—are deposited in the case of full color mode) with respect to the background area in the background portion of each sheet of the normal paper and coated paper.

FIG. 5 shows the characteristic curves for the normal paper and coated paper wherein the fog margin (V) is plotted on the horizontal axis, and the fog area ratio (%) is plotted on the vertical axis. When the fog margin is constant, the fog area ratio for the coated paper is greater than that for the normal paper. This is because even if the amount of the fog toner on the photoreceptor is the same, the transfer efficiency of transfer onto the coated paper is greater than that onto the normal paper.

When printed in the full color mode, the user cannot be recognized as such, if the fog area ratio does not exceed about 2%. Accordingly, if the fog area ratio can be kept at 2% or less, quality problem does not arise with the passage of time. In the example given in FIG. 5, when the normal paper is utilized, the fog margin is set to about 20 V or more, and when the coated paper is employed, the fog margin is set to about 90 V or more. If this setting is ensured, the fog area ratio is kept at 2% or less, and no quality problem occurs.

If the fog margin is excessive, there will be a decrease in the proportion of the fog toner ejected out of the development apparatus, and the fog toner in the amount corresponding to that amount will be accommodated in the development apparatus. Then the fogging level in printing a large number of sheets will be deteriorated in a short time. To avoid this, the fog area ratio is preferably kept at the upper limit (about 2%) wherein the user cannot identity the fog. However, fogging level may vary according to the environmental variation and others, and therefore a margin of safety should be taken into account when setting the fog margin.

In the monochromatic mode, the relationship between the fog margin and fog area ratio exhibits the same characteristics as those in the full color mode, although this is not illustrated. The fog area ratio in the monochromatic mode wherein the fog cannot be identified by the user is lower than that in the full color mode and is about 1% or less, because fog toner is made up of only a black color (where the Y, M and C photoreceptors are apart from the intermediate transfer member) and is conspicuous. If the fog area ratio can be kept 1% or less chronologically, there is no quality problem. Thus, similarly to the case of full color mode, the fog area ratio is preferably maintained at the upper limit (about 1%) wherein the fog cannot be identified by the user.

The fog control parameters include the peak-to-peak value and frequency of the Vb (AC) in addition to the surface potential V0 for adjusting the aforementioned fog margin, and the DC component Vb (DC) of the development bias. It goes without saying that a combination of these parameters can also be used a fog control parameter.

Generally, reduction of the peak-to-peak value of the Vb (AC) tends to reduce the fog area ratio, and increase of the frequency of the Vb (AC) tends to decrease the fog area ratio. This may differ according to the development system in some cases.

<Fog Control Flow>

The fog control is divided into two forms. One is the form of control for correcting the chronological fog variation. Here the output value of the fogging level detection sensor 30 is detected at predetermined timed intervals, and the reference fog control parameter value is determined based on the output value having been detected (hereinafter referred to as "fog variation correction control"). Another is the form of control of the present invention, wherein the fog control parameter value at the time of image formation is controlled in response to the recording medium (hereinafter referred to as "recording medium-compatible control"). In the recording medium-compatible control, the aforementioned reference fog control parameter value is utilized.

Figure 6:
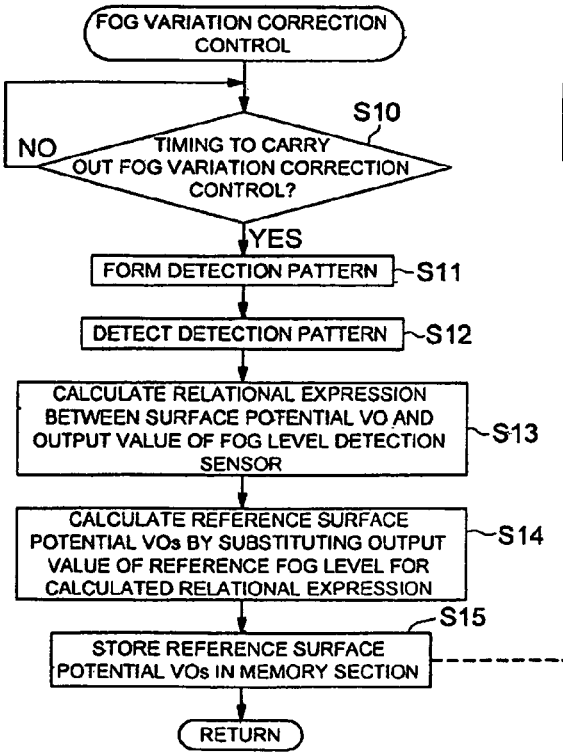
FIGS. 6(*a*) and 6(*b*) are control flow diagrams for controlling fog in the present invention, wherein FIG. 6(*a*) is a control flow chart showing the fog variation correction control, and FIG. 6(*b*) is a control flow chart showing the recording medium-compatible control.
Figure 6:
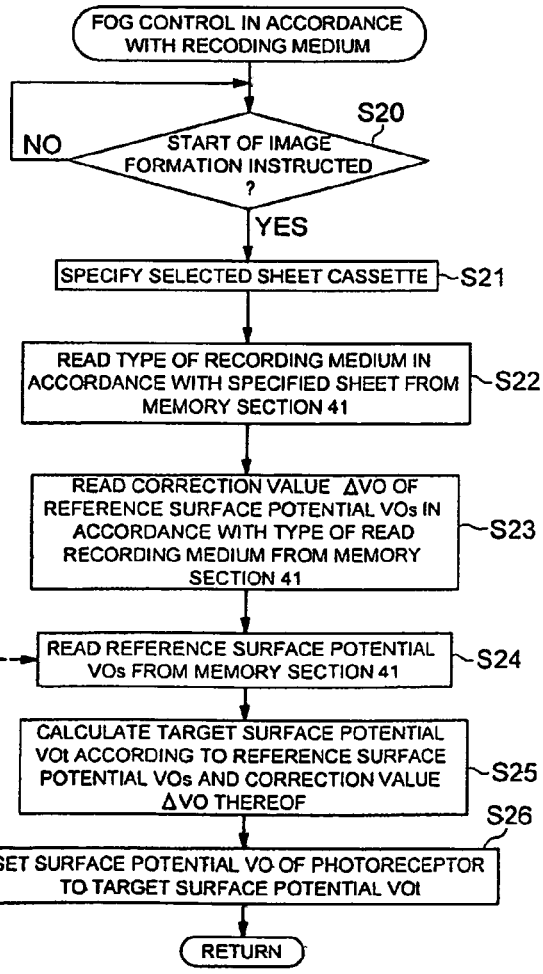

FIGS. 6(*a*) and 6(*b*) are control flow diagrams for controlling fog in the present invention. FIG. 6(*a*) is a control flow chart showing the fog variation correction control, and FIG. 6(*b*) is a control flow chart showing the recording medium-compatible control. This fog control is provided by the controller 40 according to the control program stored in the memory section 41.

By way of an example, the following describes the case of adjusting the fog margin using the photoreceptor surface potential V0 as a fog control parameter in the full color mode. The fog margin can be adjusted by using the DC component Vb (DC) of the development bias as the fog control parameter, or the peak-to-peak value of the Vb (AC) or the frequency of Vb (AC) can be used as the fog control parameter. The same procedure also applies to the monochromatic mode.

The sheet cassette 50A accommodates normal paper, and the sheet cassette 50B stores coated paper. The sheet cassette 50A is associated with normal paper and the sheet cassette 50B is associated with coated paper, and this information of association is stored in the memory section 41, as shown in Table 1.

Further, as shown in Table 2, the correction value ΔV0 with respect to reference surface potential $V0_s$ (to be described later) is associated with the type of the recording medium, and this information is stored in the memory section 41. 0V is stored for normal paper, and +70 V is stored for coated paper.

TABLE 1

| Paper cassette | Type of recording medium |
|---|---|
| Paper cassette 50A | Normal paper |
| Paper cassette 50B | Coated paper |

TABLE 2

| Type of recording medium | Correction value (ΔV0) |
|---|---|
| Normal paper | 0 V |
| Coated paper | +70 V |

The following describes the fog variation correction control given in FIG. 6(*a*). In the first place, the controller 40 determines whether or not fog variation correction control should be carried out now (Step S10). Fog variation correction control is carried out at predetermined timed intervals, for example, at the time of warming up, and at the time of printing of a predetermined sheets of paper.

If it has determined that fog variation correction control should be carried out (Step S10: Yes), the controller 40 forms a plurality of detection patterns of different toner densities on the photoreceptor 10 of each image forming section while adjusting the surface potential V0. In this case, control is provided in such a way that a plurality of detection patterns formed by each image forming section are superimposed on the intermediate transfer member 20 with the correspondence correctly maintained (Step S11). If it has determined that fog variation correction control should not be carried out now (Step S10: No), the controller 40 goes back to the Step S10, and waits there for the instruction to start fog variation correction control.

Then the controller 40 takes the next step of detecting a plurality of detection patterns formed on the intermediate transfer member 20, from the fogging level detection sensor 30, and obtaining the output value corresponding to each detection pattern (Step S12).

Based on the output value of the fogging level detection sensor 30 corresponding to each detection pattern and the surface potential V0 at the time of formation of the detection pattern, the controller 40 calculates the relational expression between the surface potential V0 and the output value of the fogging level detection sensor 30. For example, the regression equation is obtained by approximation to the quadratic equation using the commonly known method of least square (Step S13).

Then the controller 40 substitutes into the calculated relational expression the output value of fogging level detection sensor 30 (reference fogging level value) corresponding to the reference fogging level stored in the memory section 41, thereby calculating the reference surface potential $V0_s$ for getting the reference fogging level value. The reference fogging level value is set to the output value of fogging level detection sensor 30 wherein the fog area ratio at the time of transfer onto the normal paper will be 2%, for example (Step S14).

The controller 40 takes the next step of storing the calculated reference surface potential $V0_s$ into the memory section 41 (Step S15).

The following describes the recording medium-compatible control given in FIG. 6(*b*). In the first place, the controller 40 determines whether or not there is any instruction to start image formation (Step S20).

When it has determined that there is an instruction to start image formation (Step S20: Yes), the controller 40 specifies the selected sheet cassette (Step S21), based on the recording medium selection information inputted into the input terminal 40*a* of the controller 40 (recording medium selection information input section) from the operation section 42. If it has determined that there is no instruction to start image formation (Step S20: No), the controller 40 goes back to the Step S20, and waits there for the instruction to start image formation.

The controller 40 reads the type of the recording medium corresponding to the specified sheet cassette from the memory section 41 (Step S22). In the present embodiment, "normal paper" is read out according to Table 1 if the selected sheet cassette is the sheet cassette 50A, while "coated paper" is read out if the selected sheet cassette is the sheet cassette 50B.

The controller 40 reads from the memory section 41 the correction value ΔV0 of the reference surface potential $V0_s$ corresponding to the type of the recording medium having been read out (Step S23). In the present embodiment, "0 V" is read out in the case of normal paper according to Table 2, while "+70 V" is read out in the case of coated paper.

In the present embodiment, as described in the aforementioned Step S14, the reference surface potential $V0_s$ is set to the optimum value when transferred onto the normal paper, and therefore correction value ΔV0 of the normal paper is 0 V. The correction value ΔV0 of the coated paper is set to +70 V since it is the difference in the fog margin 70 V (=90 V−20 V) for the coated paper and normal paper when the fog area ratio in FIG. 5 is 2%. The correction value ΔV0 for various types of recording media is determined by previously obtaining the characteristic data as given in FIG. 5, and is stored in the memory section 41.

Then the controller 40 takes the next step of reading out the reference surface potential $V0_s$ from the memory section 41 (Step S24). This reference surface potential $V0_s$ is updated every time the fog variation correction control is carried out.

Then, based on the correction value ΔV0 between the reference surface potential $V0_s$ and the reference surface potential $V0_s$, the controller 40 calculates the target surface potential $V0_t$ for the recording medium (Step S25). In the present embodiment, the "target surface potential $V0_t$=reference surface potential $V0_s$+0 V" is calculated for the normal paper, whereas the "target surface potential $V0_t$=reference surface potential $V0_s$+70 V" is calculated for the coated paper. As described above, the target surface potential $V0_t$ is set in such a way as to correct the value of the reference surface potential $V0_s$. This solves possible problems when there is a chronological change in the reference surface potential $V0_s$, and ensures higher precision setting of the fogging level.

The controller 40 then takes the next step of setting the surface potential V0 of the photoreceptor to the target surface potential $V0_t$ (Step S26). Image formation then starts according to the target surface potential $V0_t$ having been set. In the present embodiment, the target surface potential $V0_t$ for the coated paper is set at a level 70 V higher than the target surface potential $V0_t$ for the normal paper.

As described above, according to the present invention, at the time of image formation, the fog control parameter is set in such a way that the amount of the fog toner deposited on the photoreceptor will increase when using the normal paper characterized by lower transfer efficiency and less conspicuous fog, whereas the amount of the fog toner deposited on the photoreceptor will decrease when using the coated paper characterized by higher transfer efficiency and mores conspicuous fog. This arrangement allows much fog toner to be deposited on each of the normal and coated sheets without being conspicuous. Thus, the largest possible amount of poorly charged toner is discharged from the development apparatus and a greater proportion thereof is collected by the sheets. Accordingly, high quality image with less conspicuous fog is ensured for both the normal and coated paper, and fog deterioration is minimized for a long period of time.

In the present embodiment, the correction value ΔV0 of the reference surface potential $V0_s$ of the coated paper is set at +70 V. It goes without saying that this value varies according to the type of the coated paper. The correction value ΔV0 of the reference surface potential $V0_s$ is set in the memory section 41 for each type of the coated paper.

In the present embodiment, recording medium selection information is inputted into the controller 40 by selection of the sheet cassette through the operation section 42. It is also possible to make such arrangements that recording medium selection information is inputted into the controller 40 by direct section of the type of the recording medium through the operation section 42. When the image forming apparatus is a printer, it is also possible to arrange such a configuration that recording medium is selected using a printer driver installed on a PC linked via the network such as LAN, and recording medium selection information is inputted into the controller 40.

In the present embodiment, fog control is made up of two forms; fog variation correction control and recording medium-compatible control, and this is a preferable arrangement. In the present invention, recording medium-compatible control alone is sufficient for the purpose, and fog variation correction control is not always essential. In this case, the reference fog control parameter (reference surface potential $V0_s$ in the present invention) is a fixed value without being controlled chronologically.

In the present embodiment, the present invention is applied to the tandem full color image forming apparatus. Needless to say, it is applicable to an image forming apparatus of monochromatic mode. In this case, the fog control parameter value is preferably set for each recording medium so that the target fog area ratio will be 1% for both the normal and coated paper.

In the present embodiment, the fog control program is stored in the memory section 41. At the time of updating, this fog control program is downloaded from a server linked, for example, via the network such as the Internet.

What is claimed is:

1. An image forming apparatus comprising:

a toner image carrier which carries a toner image thereon;

a recording medium selection information input section to which recording medium selection information is inputted to select a recording medium to which the toner image carried on the toner image carrier is transferred;

a fog controller which sets a fog control parameter value to control a fogging level of the toner image carrier; and an image forming section which forms the toner image to be carried on the toner image carrier based on the fog control parameter set by the fog controller, wherein the fog controller sets the fog control parameter value so that the fogging level of the toner image carrier when the recording medium selection information inputted corresponds to a coated sheet, is lower than that when the recording medium selection information inputted corresponds to a normal sheet, a memory section which stores a reference fog control parameter value and correction values of the reference fog control parameter values corresponding to the coated sheet and the normal sheet, wherein the fog controller sets the fog control parameter values on the basis of the reference fog control parameter value and the correction values of the reference fog control parameter values corresponding to the coated sheet and the normal sheet.

2. The image forming apparatus of claim 1, further comprising:

a detection pattern forming section which forms a detection pattern to detect the fogging level on the toner image carrier; and a fogging level detection section which detects a fogging level by detecting the detection pattern formed by the detection pattern forming section, wherein the memory section stores a reference fog level value, and the fog controller determines the reference fog control parameter on the basis of a fogging level value detected by the fog level detection section and the reference fog level value stored in the memory section.

3. The image forming apparatus of claim 1, wherein the toner image carrier is an intermediate transfer member, the image forming apparatus further comprising:

a plurality of image forming sections each having:

an electrostatic latent image carrier provided opposite to the intermediate transfer member, a charging unit which charges a surface of the electrostatic latent image carrier, an exposure unit which exposes the surface of the electrostatic latent image carrier charged by the charging unit to form an electrostatic latent image on the surface of the electrostatic latent image carrier, and a developing device which develops the electrostatic latent image by a developer bearing member that holds a toner thereon to form a toner image on the surface of the electrostatic latent image carrier;

and a transfer device provided opposite to each of the plurality of image forming sections, which transfers the toner image that has been formed on the surface of the electrostatic latent image carrier onto a surface of the intermediate transfer member.

4. The image forming apparatus of claim 1, wherein the toner image carrier is an electrostatic latent image carrier around which the image forming apparatus further comprising:

a charging unit which charges a surface of the electrostatic latent image carrier, an exposure unit which exposes the surface of the electrostatic latent image carrier charged by the charging unit to form an electrostatic latent image on the surface of the electrostatic latent image carrier, and a developing device which develops the electrostatic latent image by a developer bearing member that holds a toner thereon.

5. The image forming apparatus of claim 3, wherein the fog control parameter corresponds to a surface potential of the electrostatic latent image carrier which is charged by the charging unit.

6. The image forming apparatus of claim 4, wherein the fog control parameter corresponds to a surface potential of the electrostatic latent image carrier which is charged by the charging unit.

7. The image forming apparatus of claim 1, wherein the image forming section comprises a developing device which develops an electrostatic latent image by a developer bearing member that holds a toner thereon to form a toner image, and the fog control parameter corresponds to a developing bias voltage to apply to the developer bearing member.

8. The image forming apparatus of claim 7, wherein the developing bias voltage has an alternate current component, and the fog control parameter corresponds to a peak-to-peak voltage of the alternate current component.

9. The image forming apparatus of claim 7, wherein the developing bias voltage has an alternate current component, and the fog control parameter corresponds to frequency of the alternate current component.

10. The image forming apparatus of claim 1, wherein the fog control parameter value set by the fog controller is determined on the basis of a target fog area ratio.

11. The image forming apparatus of claim 3, wherein the plurality of image forming sections comprises a yellow image forming section, a magenta image forming section, a cyan image forming section and a black image forming section, wherein the image forming apparatus has a monochromatic mode in which image formation is carried out using black image forming section only, and a full color mode in which the image formation is carried out using all of the yellow image forming section, the magenta image forming section, the cyan image forming section and the black image forming section, wherein the fog control parameter value set by the fog controller is determined on the basis of a target fog area ratio, and the target fog area ratio in the monochromatic mode is different from that in the full color mode.

12. The image forming apparatus of claim 11, wherein the target fog area ratio in the monochromatic mode is smaller than that in the full color mode.

13. The image forming apparatus of claim 1, wherein the recording medium selection information is information which is inputted by an operation of an operation section.

14. The image forming apparatus of claim 1, wherein the recording medium selection information is information which is inputted using a printer driver.

15. An image forming apparatus comprising:

a toner image carrier which carries a toner image thereon;

a recording medium selection information input section to which recording medium selection information is inputted to select a recording medium to which the toner image carried on the toner image carrier is transferred;

a fog controller which sets a fog control parameter value to control a fogging level of the toner image carrier; and an image forming section which forms the toner image to be carried on the toner image carrier based on the fog control parameter set by the fog controller; and a memory section which stores a reference foci control parameter value and correction values of the reference foci control parameter values corresponding to the coated sheet and the normal sheet, wherein the fog controller sets the fog control parameter value so that the fogging level of the toner image carrier when the recording medium selection information inputted corresponds to a coated sheet, is lower than that when the recording medium selection information inputted corresponds to a normal sheet so that fog is not recognized by an operator, and is deposited on each of the normal and coated sheets, wherein the foci controller sets the foci control parameter values on the basis of the reference foci control parameter value and the correction values of the reference foci control parameter values corresponding to the coated sheet and the normal sheet.

16. The image forming apparatus of claim 15, further comprising:

a detection pattern forming section which forms a detection pattern to detect the fogging level on the toner image carrier; and a fogging level detection section which detects a fogging level by detecting the detection pattern formed by the detection pattern forming section, wherein the memory section stores a reference fog level value, and the fog controller determines the reference fog control parameter on the basis of a fogging level value detected by the fog level detection section and the reference fog level value stored in the memory section.

17. The image forming apparatus of claim 15, further comprising a memory section which stores information relating to the fog control parameter corresponding to the coated sheet and the normal sheet, wherein the fog controller sets the fog control parameter values on the basis of the information relating to the fog control parameter which has been stored in the memory section.

18. The image forming apparatus of claim 17, wherein the information relating to the fog control parameter represents a reference fog control parameter value and correction value of the reference fog control parameter values corresponding to the coated sheet and the normal sheet.

* * * * *